United States Patent [19]

Cameron

[11] Patent Number: 4,697,487

[45] Date of Patent: Oct. 6, 1987

[54] ADJUSTABLE CABLE DRIVEN CARRIAGE SYSTEM AND METHOD

[76] Inventor: Robert E. Cameron, P.O. Box 251, Warrenton, Oreg. 97146

[21] Appl. No.: 419,998

[22] Filed: Sep. 20, 1982

[51] Int. Cl.[4] ..... B27B 29/08; B27B 15/08

[52] U.S. Cl. ..... 83/708; 83/712; 83/731; 83/409; 83/425.2; 83/435.1; 83/435.2; 144/378

[58] Field of Search ..... 83/435.2, 708, 731, 83/409, 158, 157, 425.2, 433, 435.1, 710, 711, 712, 412, 403.1; 144/312, 378; 198/748, 604

[56] References Cited

U.S. PATENT DOCUMENTS

| | | | |
|---|---|---|---|
| 3,503,428 | 3/1970 | Ackerfeldt | 143/25 |
| 3,731,578 | 5/1973 | Ackerfeldt | 83/731 |
| 3,747,455 | 7/1973 | Hartzell et al. | 83/708 X |
| 3,872,758 | 3/1975 | Hartzell et al. | 83/708 |
| 3,875,841 | 4/1975 | Noble et al. | 83/708 |
| 4,250,937 | 2/1981 | Detjen | 83/731 X |
| 4,287,798 | 9/1981 | Cooper et al. | 83/708 |
| 4,445,411 | 5/1984 | Purcell | 83/409 X |

*Primary Examiner*—Donald R. Schran
*Attorney, Agent, or Firm*—Delbert J. Barnard

[57] ABSTRACT

An end-dogging log carriage system has two narrow, carriage sections, supportably guided on an elongated track, interconnected by a drive cable and a clamping cable. Both cables are wrapped around a spooling drum mounted on one of the carriage sections in such a way so that rotation of the spooling drum simultaneously changes the operative length of both clamping and drive cables thereby moving one carriage section with respect to the other to adjust the length of the log carriage and clamp a log therebetween. The tension in the cable system acting at the cable attachment points on each carriage section provides therein a preinduced countermoment in opposition to the dogging moment occurring when a log is dogged. The carriage sections are laterally biased against a single sidemounted guide rail spaced from the supporting track and discontinuous proximate the saws by a preloaded torque shaft mounted on each carriage section. Each carriage section has selectively retractable and extensible turning dogs powered by a hydraulic vane motor capable of rotating a clamped log 90° during processing. The entire carriage system may be used alternatively as an overhead carriage, an underneath carriage, or in tandem as an overhead and underneath log carriage system using one array of log-processing equipment.

37 Claims, 9 Drawing Figures

ADJUSTABLE CABLE DRIVEN CARRIAGE SYSTEM AND METHOD

DESCRIPTION

1. Technical Field

This invention relates to an adjustable carriage system for carrying random length logs, or the like, through processing equipment, and to an article engaging and carrying method.

2. Background Art

Adjustable end-dogging log carriages customarily have one system for driving the loaded log carriage through the saws or other log processing equipment and an entirely separate system for adjusting the length of the log carriage to accept logs of varying length and clamping such random length logs. Log carriage systems such as that disclosed in Noble U.S. Pat. No. 3,875,841 are typical of the type which use one system, such as a cable drive attached to only one of the log carriage sections, to pass the log carriage through the saws and a second independent system, such as a hydraulic cylinder extending between both log carriage sections, to adjust the length of the log carriage and dog the log. Ackerfeldt U.S. Pat. No. 3,503,428, discloses an adjustable end-dogging log carriage system which performs all of the above-discussed functions with one system in which both log carriage sections are connected to a common drive line. However, it accomplishes this by using a complicated mechanical coupling device to selectively connect and disconnect independent log carriage sections from the common drive line.

End-dogging log carriages typically apply the dogging or clamping force along an axis which is generally parallel to both the axis of the log and the axis of the carriage track. While it is preferable that this dogging axis be proximate the longitudinal axis of the log to minimize the rotational force caused by the moment arm betweem the axis of force application and the axis of force resolution, any distance between the axis of application of the dogging force and the longitudinal axis of the log results in a rotational moment in the log carriage. This rotational moment is a major problem in overhead-supported end-dogging carriages since the dogging axis is usually colocated with the carriage track which is typically spaced considerably above the axis of the log. In such overhead, end-dogging log carriages, this moment tends to unseat the log carriage from the overhead track necessitating various engineering countermeasures. For example, a log carriage system manufactured by Farwest Equipment and Control of Eugene, Ore., under the designation "High Recovery Small Log System" employs a mast which extends between the log carriage sections to compensate for this moment and "hold-down" wheels which are associated with each carriage section to keep the log carriage from unseating itself from the overhead track. Indeed, most modern overhead adjustable end-dogging log carriages compensate for this induced dogging moment by providing such a rigid mast or boom between the fore and aft carriage sections which often displays visible deflection during dogging. The Ackerfeldt patent, which shows no such structural member, appears to attempt to compensate for this moment by having an unnumbered wheel mounted below the carriage track as shown in FIG. 3 which would prevent the portion of the log carriage section furthest from the log from lifting off the carriage track. The problem associated with the dogging moment is not as severe in underneath-supported, adjustable end-dogging log carriages because the carriage track, which is usually colocated with the dogging mechanism, is typically arranged closer to the log. However, as previously explained, any distance between the dogging axis and log axis will induce a dogging moment which must be compensated for by adequate structure to resist the dogging moment, as accomplished in Noble FIGS. 2 and 3 wherein a slide bar 46 is closely mounted in a base 45 preventing all but axial movement between the slide bar and the base.

Declining availability of large old growth timber and the general realization that forests are a dwindling resource have emphasized the need for high recovery processing of smaller logs. The quest for a high degree of accuracy in the primary breakdown phase of log processing which is required to achieve high recovery has resulted in increased emphasis on exact alignment of the log as it passes through the saws. An effective carriage guide system to ensure that the log precisely maintains a desired alignment relative to the saws is necessary to achieve such high accuracy. Another advantage of an accurate carriage guide system is that it lessens the requirement for lateral stability and rigidity of the log carriage and supporting carriage track, allowing lighter and more economical constructions thereof.

Prior art carriage guides for overhead carriages have been of two general types, both variations of a "sandwich" principle. All types of sandwich guides are limited in their accuracy because a certain amount of lateral clearance or "play" must be allowed to prevent binding of the carriage in the guide as it travels along the guide and because wear resulting from the lateral pressure of the log carriage as it passes through the guide increases this play. One type is a side-mounted sandwich guide such as shown in FIGS. 2 and 4 of the Ackerfeldt patent wherein a continuous guide member is provided to one side of the log carriage path and a guide-engaging member extending from the log carriage or from each log carriage section engages this guide element in a grooved, channeled or forked arrangement. In addition to the disadvantages associated with all sandwich-type guides explained above, such a continuous side-mounted guide cannot be used in conjunction with a pair of opposed band mills which straddle the log path and simultaneously saw opposite sides of the log, which are currently prevalent in the industry, because the continuous guide element and the guide-engaging member would interfere with the band mill located on the same side of the log path as the guide. The other general type of sandwich guide for overhead carriages is one which brackets the path of the log carriage and thereby limits lateral movement of the log carriage as shown in FIGS. 5A, 5B, 5C and 7 of the Ackerfeldt patent. Since upper sandwich guides and associated support structure would tend to interfere with a pair of opposed band mills and also obstruct the operator's vision, a lower sandwich guide located beneath the log, of the type shown in FIG. 7 of Ackerfeldt, is customarily used proximate the saws. This particular type of guide has an additional problem associated with it because splinters, sawdust and other wood debris from the sawing process can accumulate in the guide channel causing inaccurate guiding.

Known end-dogging log carriage systems can generally be categorized into overhead and underneath configurations, the two categories having few common design features. Overhead carriages such as those of Ackerfeldt and Farwest are clearly designed to be supported on an overhead track and would not function in an underneath configuration without extensive structural and design revisions. Similarly, the underneath carriage of Noble could not be upended and used in an overhead configuration. Detjen U.S. Pat. Nos. 4,009,632, 4,146,072, 4,152,960 and 4,206,673 disclose overhead and underneath drive configurations, but they cooperate to clamp the ends of a single log rather than each providing a separate log carriage. Consequently, an end-dogging log carriage system that can be easily adapted to operate in either an overhead or underneath configuration and which would also be capable of being used in tandem, with both overhead and underneath log carriages each alternately reciprocatingly passing respective logs through a single array of log processing equipment, is not available.

Primary breakdown equipment consisting of a single saw or one or more pairs of opposed saws typically slice boards or flitches off a log, such pieces usually having irregular edges that require further processing by an edger. Some overhead carriage systems use a bottom face chipper in conjunction with pairs of opposed saws or chippers to produce a cant with only one irregular face, still necessitating further processing but allowing such processing to be by a "line bar resaw" arrangement, which requires two adjacent flat or regular faces for proper alignment at the line bar. A primary breakdown system that is capable of yielding a center cant having regular, flat faces which does not require further primary breakdown has obvious advantages. One such system is that manufactured under the designation Maxi-Mill by Warren and Brewster Co. of Albany, Ore., where the log is turned 90° while dogged between the carriage sections. In such systems this is accomplished by having a turning motor connected to a turning dog by a turning shaft. The turning motor, located upstream from the saws, does not pass through the saws, and the portion of the log carriage incorporating the turning dog is not selectively extensible and retractable to clear the waiting log and charging apparatus when the carriage is returning to the home position as is customary in modern overhead carriages. Lacking the ability to selectively retract and extend the dogging mechanism also creates problems in undogging the center cant which ofter tends to remain impaled on the spikes of the dogs, thus causing delays and safety hazards. An on-carriage turning system such as that of Warren and Brewster would also prohibit a tandem overhead and underneath configuration as discussed above because the turning dog would not be capable of retracting during carriage return to clear the other one of the pair of tandem carriages passing a clamped log through the saws.

DISCLOSURE OF THE INVENTION

The aforementioned problems associated with adjustable end-dogging log carriage systems are overcome in the present invention which provides a log carriage system having: and integral cable system to drive the log carriage, adjust the length of the log carriage and dog the log; an inherent countermoment in opposition to the dogging moment; a single, sidemounted discontinuous carriage guide rail against which carriage sections are laterally biased; selectively extensible and retractable turning dogs associated with each log carriage section, and a carriage design capable of being configured as an overhead, underneath, or tandem log carriage system.

In an overhead configuration, two independent log carriage sections are movably supported on a longitudinally-extending overhead track consisting essentially of an H-beam with wear plates. Associated with each of the log carriage sections are selectively extensible and retractable turning dogs for supportably engaging the longitudinal extremities of a log. The forward or "downstream" carriage section closest to the saws, called the fixed carriage section, remains relatively fixed in position during carriage length adjustment and dogging, while the rearward or "upstream" carriage section furthest from the saws, called the movable carriage section, moves to adjust the carriage length and dog the log. A drive cable, attached to the upper downstream edge of the fixed carriage section, is passed forward around a free-turning cable sheave mounted past the end of the overhead track downstream from the saws, and passed back upstream the entire length of the overhead track and wrapped several times around a carriage drive drum located at the rearward extremity of the overhead track and coupled to a reversible hydraulic motor. The cable is then passed back downstream to the movable carriage section where it is wrapped clockwise several times around a spooling drum mounted in the upper portion of the movable carriage section and secured. A second cable, the clamping cable, is secured to the spooling drum, wrapped several times clockwise around the drum, and passed under a pulley located near the lower downstream edge of the movable carriage section and then passed further downstream to the lower upstream edge of the fixed carriage section where it is secured.

In operation, with the spooling drum on the movable carriage section locked, the reversible hydraulic motor coupled to the carriage drive drum can move both carriage sections in unison along the overhead track in either direction by means of the drive cable. Conversely, the spooling drum, powered by two reversible motors respectively coupled to the spooling drum by chain and sprocket arrangements, can move the movable carriage section along the overhead track with respect to the fixed carriage section simultaneously changing the length of both cables without detaching the movable carriage section from either cable. Clockwise rotation of the spooling drum will cause the movable carriage section to move away from the fixed carriage section and thereby lengthen the log carriage, while counterclockwise rotation of the spooling drum causes the movable carriage section to move toward the fixed carriage section to shorten the log carriage and clamp a log between respective extended turning dogs. The spooling drum may then be locked in that position, and the carriage drive drum may move the log carriage with the clamped log through the log processing equipment.

Attaching the clamping cable proximate the lower upstream edge of the fixed carriage section and passing it under a pulley mounted at the lower downstream edge of the movable carriage section positions the axis of the dogging force close to the longitudinal axis of the log thereby minimizing the moment arm between force application and force resolution and, as a consequence, minimizing the resultant rotational force which tends to unseat the carriage from the overhead track during application of dogging force. Furthermore, tension in the drive cable which also acts on the upper part of each carriage section in the opposite direction from the force imposed on the lower part of each carriage section by the clamping cable creates a countermoment which is in opposition to the dogging moment caused by a log being clamped between the extended dogs. Each carriage section is thereby preloaded with such countermoment, the log carriage achieving substantiaal equilibrium when a log is dogged.

A single, longitudinally-extending, side-mounted carriage guide rail extends parallel to the overhead track at a level corresponding vertically to the lower extremities of the carriage sections and above the dogs. The carriage guide rail consists of a vertically-oriented linear bearing surface mounted on a rigid support structure. Four needle bearings appended to the bottom of each carriage section are caused to rollingly engage the carriage guide rail by a lateral biasing force. This lateral biasing force is supplied by two "V" wheels which are mounted on axle arms at the upper front and rear of each carriage section on the side opposite from the carriage guide rail. The "V" wheels engage a "V" rail which is rigidly mounted parallel to the carriage track and off to the side. The axle arms are fixedly coupled to a torque shaft which has rotational force applied to it. This rotational force, transmitted through the respective axle arms results in an upward force by the respective "V" wheels against the "V" rail and a lateral force tending to urge the lower portion of each carriage section toward the carriage guide rail where the bearings engage the guide rail. Each carriage section is thereby rigidly guided at the top by the carriage track and "V" rail and near the bottom by the carriage guide rail. This lateral biasing gives great lateral stability to the log carriage and eliminates the need for a massive or wide set track structure allowing the primary structure of the overhead track to be a single H-beam.

The carriage guide rail is above the dogs to prevent wood waste from collecting thereon which might otherwise introduce inaccuracy into the guiding function, and such guide rail is discontinuous immediately proximate the band saws, defining a gap therein, to allow the band saw on the same side of the carriage path as the carriage guide rail to be adjusted along an axis perpendicular to the carriage path according to the desired cutting pattern for a particular log. The elongated carriage sections are of sufficient length, and the bearings are appropriately spaced, so that three of the four bearings on each carriage section are always in contact with the carriage guide rail as the carriage passes the log through the saws, the carriage sections spanning the gap in the carriage guide rail and ensuring consistent alignment of the log with respect to the saws.

Each carriage section includes selectively extensible and retractable turning dogs pivotably extended and retracted by a controllable hydraulic cylinder. Another controllable hydraulic cylinder associated with each dog acts to lock the turning dog in an extended position. Each turning dog includes a textured gripping face to supportably engage the end of a log which may be selectively rotated 90° about an axis perpendicular to the gripping face by a reversible hydraulic vane motor small enough to fit between the band saws. In operation, the log carriage is positioned and its length is adjusted to receive a particular log from the charging apparatus, the turning dogs are extended and locked, and the log is clamped between the two turning dogs. Desired cuts may be taken by the saws prior to rotating the clamped log 90°, after which additional cuts may be taken, or the log may be rotated 90° before taking the initial cuts, then rotated back 90° and the cutting finished, allowing optimum processing of any log without realigning it with respect to the cutting machinery.

Since the hanging weight of the carriage is not needed for carriage stability, the stability of the carriage being supplied longitudinally by the carriage sections, and laterally by the lateral biasing against the guide rail, the carriage system may be upended and employed as an underneath carriage assembly. The weight of the carriage would be supported on the axle arm and "V" wheel assembly, the carriage being guided by an I-beam track such as used in the overhead configuration and by a similar guide rail. Neither the integral drive system nor the turning dogs rely upon gravity for any operation and would be unaffected by the positional shift. With sufficient provisions for a variable position charger, and modifications to the undogging area to ensure that the released cant is removed, the overhead and underneath carriages can be operated in tandem. Accordingly, each carriage can alternatingly reciprocatingly process a rapid succession of logs through the same array of log processing equipment, each carriage, when returning to the home position to receive another log, having its respective turning dogs retracted so as to allow unobstructed passage of the other carriage having a log clamped between its respective turning dogs toward the saws. While the carriage guide rail would be below the log in the underneath configuration, wood debris is less likely to collect on this type of side-facing, biased carriage guide than on a sandwich-type guide. A shielding device, such as commonly used in the industry for underneath carriages, would be necessary to keep sawdust and wood debris from falling on the carriage track and "V" rail.

Accordingly, it is a principal objective of the present invention to provide an improved, adjustable, end-dogging log carriage system and method.

It is a further object of the present invention to provide a log carriage system and method having an integral system for adjusting the length of the carriage, clamping the log, and moving the log through the saws.

It is a further object of the present invention to provide a log carriage system and method wherein both log carriage sections are connected to a common drive line and are movable with respect to each other without being detached from the common drive line.

It is still a further object of the present invention to provide an end-dogging log carriage system and method which provides a countermoment in opposition to the dogging moment.

It is a further object of the present invention to provide a an end-dogging log carriage system and method which does not become more unbalanced as a result of dogging a log.

It is a further object of the present invention to provide a highly accurate log carriage guiding system and method.

It is a further object of the present invention to provide a log carriage guiding system and method employing a single side-mounted carriage guide rail suitable for use in conjunction with a pair of opposed band mills.

It is a further object of the present invention to provide a log carriage guiding system and method having the log carriage laterally biased against a single side-mounted carriage guide rail.

It is a further object of the present invention to provide a carriage guiding system and method that is resistant to collection of sawdust and other wood debris.

It is a further object of the present invention to provide a log carriage guiding system and method which will not obstruct the operator's vision.

It is an associated object of the present invention to provide a log carriage system and method which is lightweight and economical to manufacture.

It is a further object of the present invention to provide a log carriage system and method which will increase log throughput in a random length mill by employing two alternatingly reciprocating underneath the overhead log carriages which operate in tandem serving a single array of log processing equipment.

It is a further object of the present invention to provide a log carriage system and method having selectively extensible and retractable turning dogs capable of turning the log 90° while the log is securely clamped.

Use of the system and method principles of the invention for transporting objects other than logs is also a part of the invention.

The foregoing and other objectives, features, and advantages of the invention will be more readily understood upon consideration of the following detailed description of the invention, taken in conjunction with the accompanying drawings.

BEST MODE FOR CARRYING OUT THE INVENTION

Figure 1:
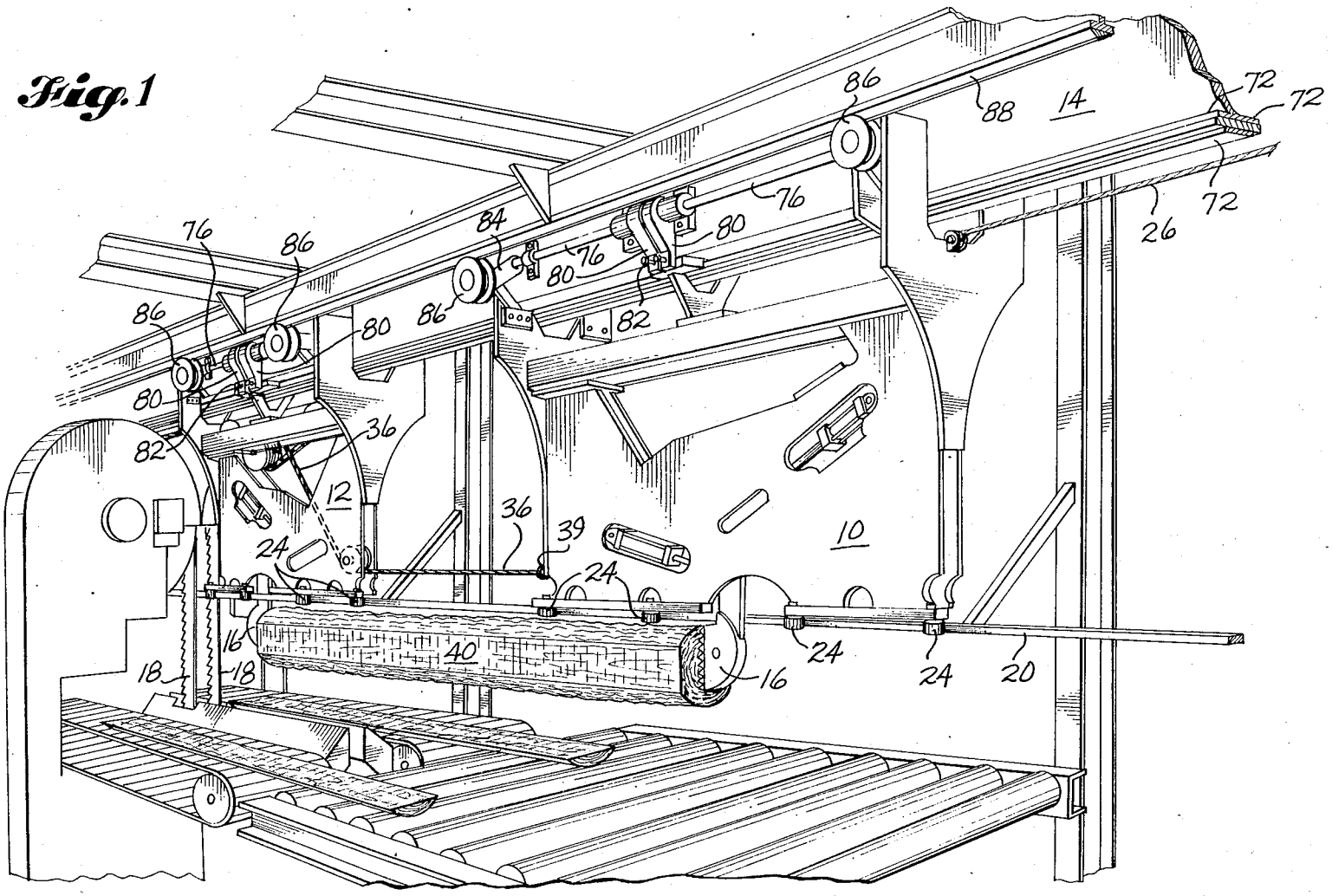
FIG. 1 is an isometric view of an exemplary embodiment of the log carriage system of the present invention employing a single log carriage.
Figure 2:
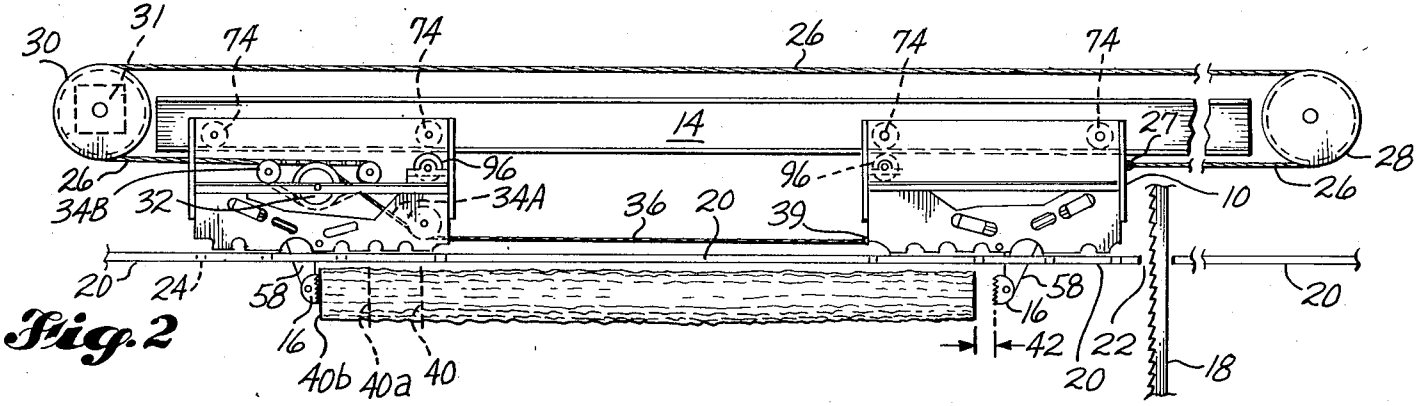
FIG. 2 is a side elevational view of the system shown by FIG. 1.

Referring to FIGS. 1 and 2, an exemplary overhead embodiment of the adjustable end-dogging log carriage system of the present invention includes two log carriage sections, a fixed carriage section 10 and a movable carriage section 12, each having respective selectively extensible and retractable dogs 16, supportably guided on a longitudinally-extending overhead track 14 for reciprocal movement along the track through log-processing equipment represented by a pair of transversely-spaced saws 18, only one of which is shown in FIG. 2. The log carriage sections are also guided by a longitudinally-extending guide rail 20 having a linear, vertically-oriented bearing surface extending parallel to the track 14 and located vertically between the track and the dogs 16. The guide rail 20 is discontinuous immediately proximate the saws 18 defining a gap 22 between the portions of the guide rail so as to accommodate movement by the saws in a direction transverse to the log carriage path. The log carriage sections are forced against the guide rail 20 by a lateral biasing force explained below. Each carriage section has four longitudinally-spaced needle roller bearings 24 appended thereto corresponding vertically to the guide rail 20 for rollingly engaging the guide rail. The bearings 24 are longitudinally-spaced on their respective carriage sections so that three of the four bearings will be continually in contact with the guide rail 20 as each carriage section spans the gap 22 in the guide rail.

Both carriage sections are connected to a common drive cable 26 which is attached to the fixed carriage section 10 at its upper downstream edge (closest to the saws 18), at point 27, passes further downstream past the saws 18 and the outfeed area where it is passed around a free-turning cable sheave 28 and back upstream the entire length of the track 14 where it is wrapped several times around a powered drive drum 30 which is coupled to a controllable, reversible motor (not shown). The drive cable 26 is then passed back downstream to the movable carriage section 12 where it is wrapped clockwise several times around a spooling drum 32 mounted thereon and secured to the spooling drum 32. The spooling drum 32 is powered by two controllable, reversible motors, a forward motor **34*a* and a rear motor 34*b*. A second cable, the clamping cable 36, is secured to and wrapped clockwise around the spooling drum 32 and then passed downstream under a pulley 38 mounted on the lower downstream edge of the movable carriage section 12 and attached to the lower upstream edge of the fixed carriage section 10, at point 39 (FIG. 1). With the spooling drum 32 locked, the drive drum 30 acting through the drive cable 26 can drive both carriage sections in unison along the track 14 and thereby pass a log 40, which has been clamped between the respective dogs 16 downstream through the saws 18 and return the carriage sections back upstream. Conversely, the spooling drum 32 can cause the movable carriage section 12 to move along the track 14 with respect to the stationary fixed carriage section 10 by simultaneously changing the operative length of both the drive cable 26 and the clamping cable 36 for changing the length of the log carriage and clamping a log 40 between the fixed 10 and movable 12 carriage sections. Clockwise rotation of the spooling drum 32 will act to shorten the operative length of the drive cable 26 and lengthen the operative length of the clamping cable 36 thereby lengthening the log carriage, while counterclockwise rotation of the spooling drum will simultaneously lengthen the operative length of the drive cable and shorten the operative length of the clamping cable to shorten the log carriage and clamp any of different-length logs 40, 40*a* or 40*b* between the respective log carriage sections. It will be appreciated that simultaneous operation of the spooling drum 32 and the drive drum 30 will cause the log carriage to adjust its length "on the fly" as it moves along the track 14**, thereby saving the time which would normally be required for such an adjustment prior to clamping a log.

In operation, the drive drum 30 brings both carriage sections back from the outfeed area downstream of the saws 18 and causes the fixed carriage section 10 to be positioned proximate an arbitrary position called the "zero log line" 42 corresponding to where the charging apparatus (not shown) will always place the downstream end of any random-length log. The fixed carriage section 10 is positioned so that its associated dog 16, when extended, is slightly downstream from the zero log line 42 where a log such as 40 is typically prepositioned by the charger in longitudinal alignment with the extended dog 16. The movable carriage section 12, having its associated dog 16 typically retracted to clear the aforementioned prepositioned log, is moved with respect to the fixed carriage section 10 by spooling drum 32 to adjust the length of the log carriage to correspond to the length of the particular prepositioned log. The dog 16 of the movable carriage section 12 is then extended and locked and spooling drum 32 is rotated counterclockwise moving the movable carriage section 12 toward the fixed carriage section 10 and claiming the log 40, 40*a* or 40*b* therebetween. After the log has been securely dogged and clamped, the drive drum can move both carriage sections and clamped log in unison along the track 14 and through the saws 18. After the log has been processed, the dogs 16 may be retracted to undog the log in the outfeed area, and the log carriage may be returned upstream to obtain another log.

The cable system, including both drive cable 26 and clamping cable 36, are pretensioned to approximately 2000–3000 pounds. Noting that the drive cable 26 acts on the upper portion of each carriage section and that the clamping cable 36 acts on the lower portion of each carriage section, it will be apparent that this cable tension, acting upon each of the unloaded carriage sections will induce a moment or rotational force therein, counterclockwise in the movable carriage section 12 and clockwise in the fixed carriage section 10. Provisions for countering this preinduced moment in the unloaded condition of the carriage will be explained below. However, when a log 40 is clamped between the extended dogs 16, the log exerts a reactive force, acting on each log carriage section proximate the location of its respective extended dog 16, which is in opposition to the clamping force caused by rotation of the spooling drum 32 acting on the lower portions of each carriage section through the clamping cable 36. The vertical distance between the reactive force exerted by the log 40 on the dog 16 and the clamping force exerted by the clamping cable 36 results in a dogging moment or rotational force acting on each carriage section in opposition to the preinduced moment caused by the drive cable tension, thus placing the loaded log carriage in substantial equilibrium. It should be pointed out that while the force exerted by the drive cable 26 on the upper portions of each carriage section remains essentially constant, the magnitude of the force exerted by the log 40 is directly related to the magnitude of the clamping force exerted by the spooling drum 32. Also noteworthy is the fact that the vertical distance representing the moment arm between the force exerted by the drive cable 26 and that exerted by the clamping cable 36 is significantly greater than the vertical distance representing the moment arm between the force applied by the clamping cable 36 and the equilibrium when unloaded, and become unbalanced upon clamping a log, the present invention is unbalanced when unloaded, and in substantial equilibrium during the important phase when a log is clamped and being processed.

While the invention has been described with respect to the embodiment shown in FIGS. 1 and 2, one skilled in the art will appreciate that arranging the fixed carriage section 10 and the zero log line 42 near the saws is somewhat discretionary as is locating the drive drum at the infeed end of the carriage travel, and that the invention is not necessarily limited to such an arrangement. Moreover, the invention is not necessarily limited to a reciprocating carriage system, but could rather be employed in connection with a unidirectional carriage system operating on a closed-loop track.

Figure 3:
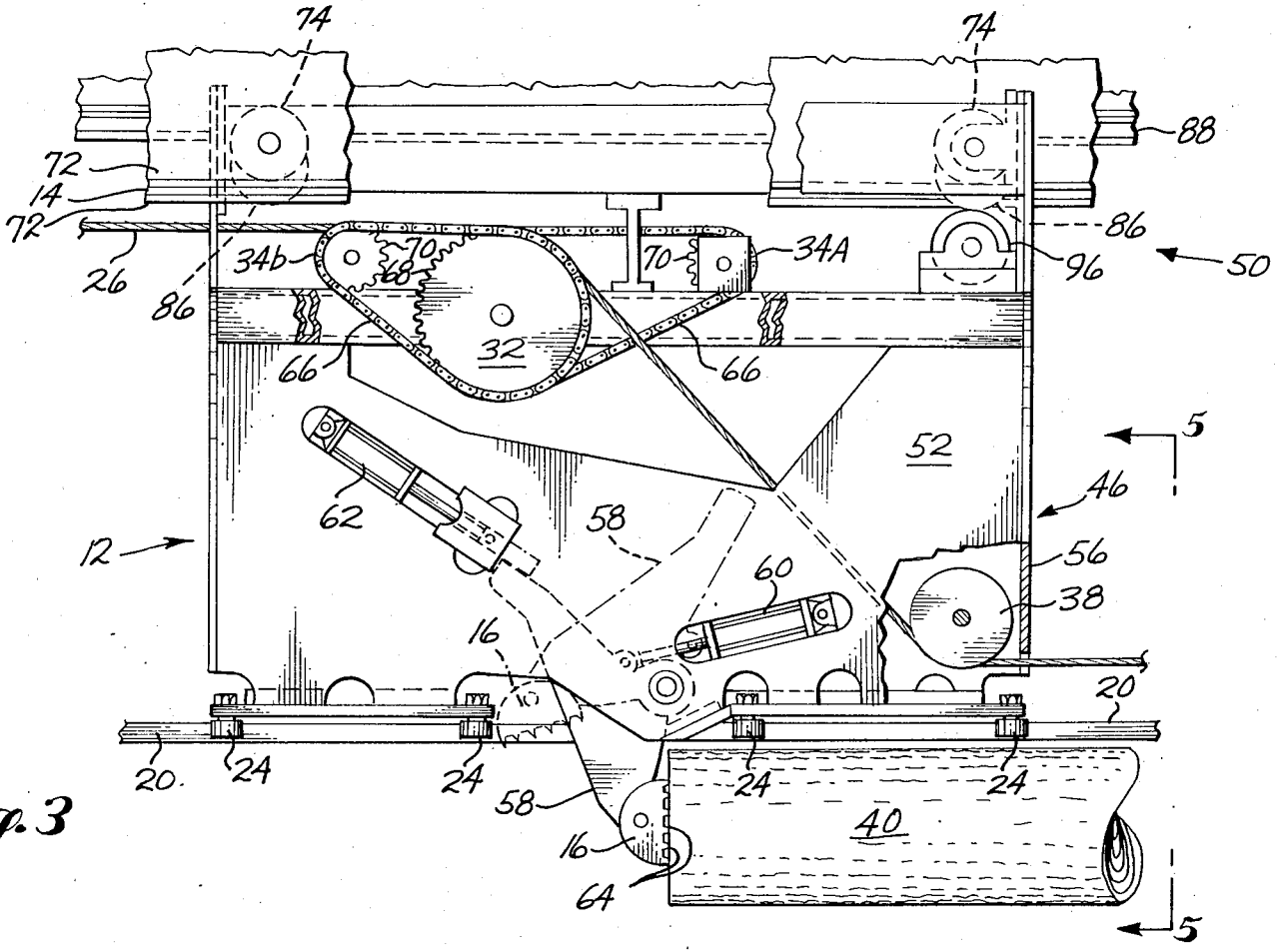
FIG. 3 is an enlarged scale, partially sectional, side elevational view of the movable carriage section of the log carriage system.
Figure 4:
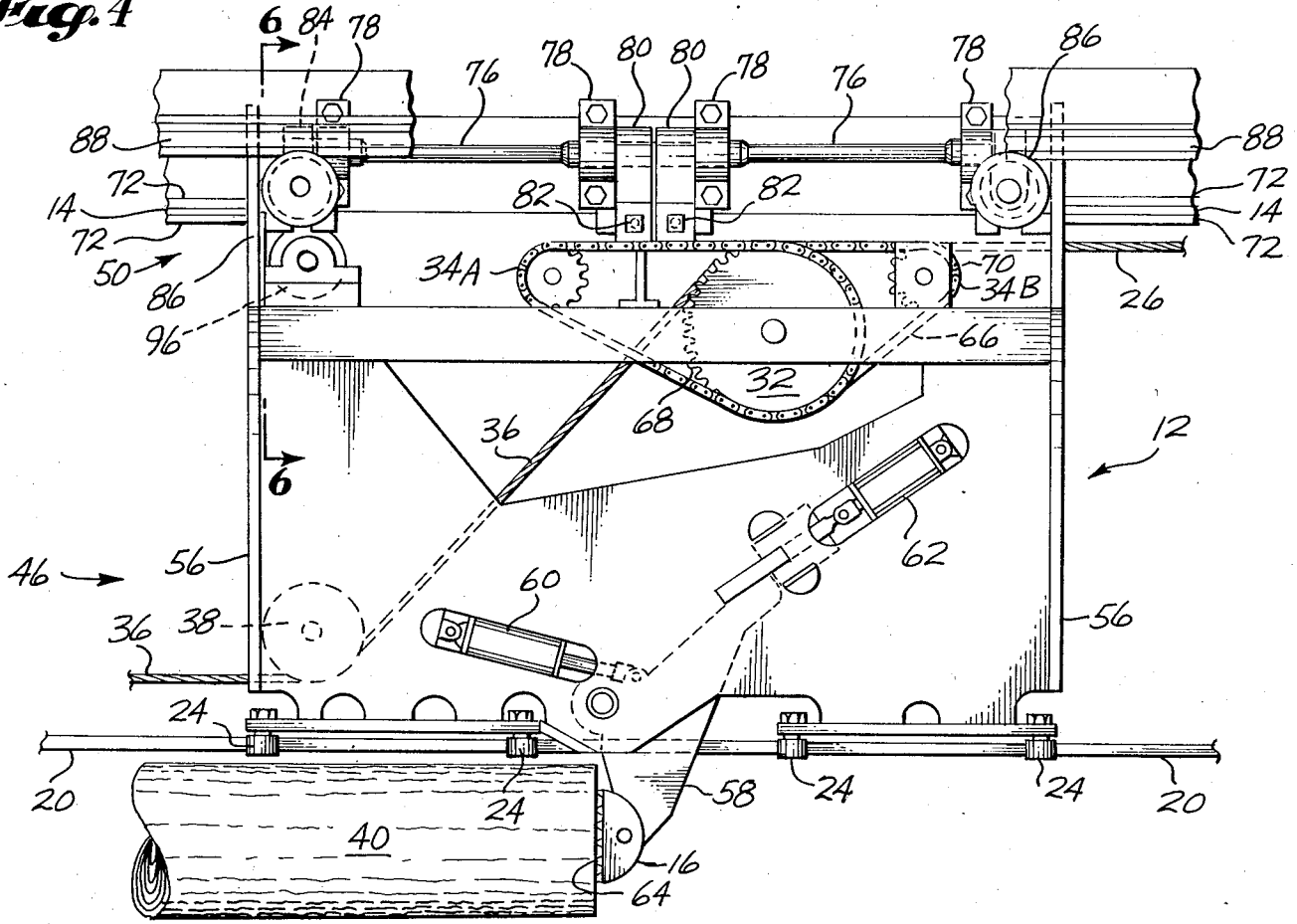
FIG. 4 is a view like FIG. 3 but of the opposite side of the movable carriage section shown in FIG. 3.
Figure 5:
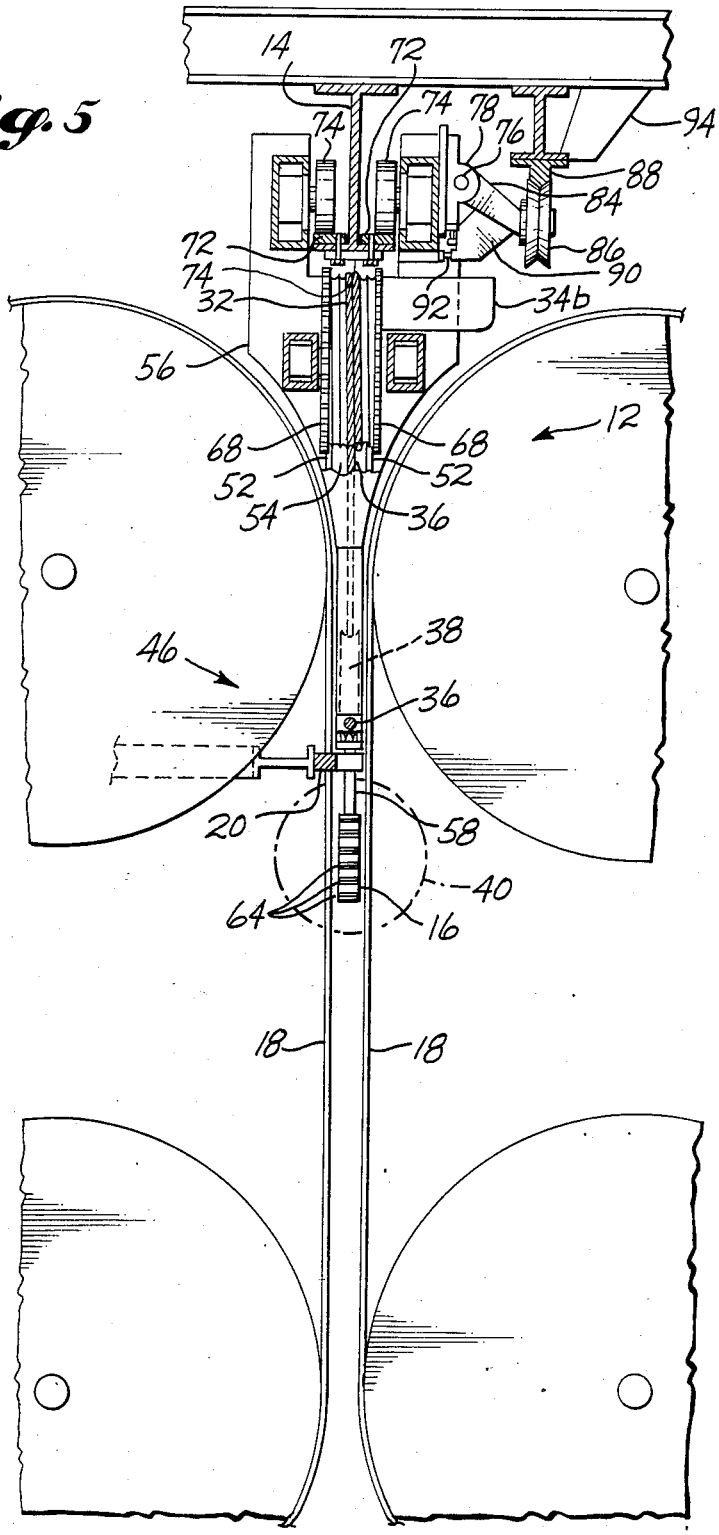
FIG. 5 is a cross-sectional view of the movable carriage section taken along line 5—5 of FIG. 3.
Figure 6:
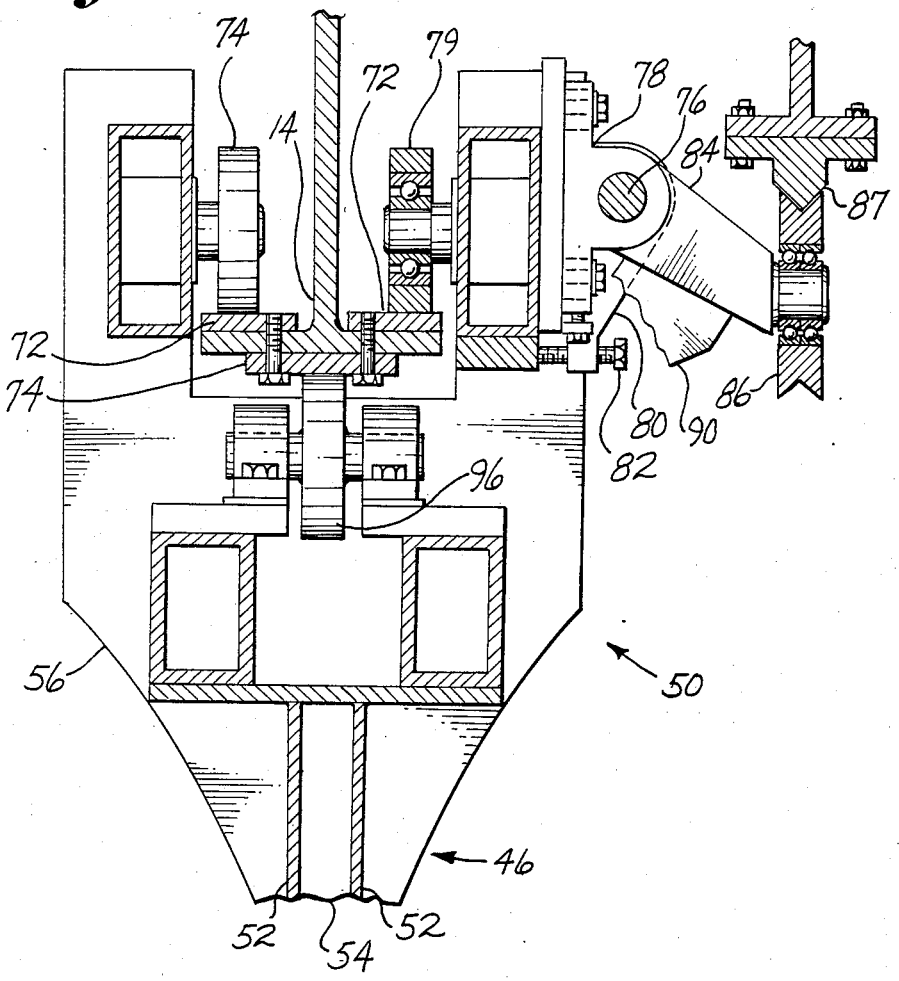
FIG. 6 is an enlarged fragmented cross-sectional view of the movable carriage section taken along line 6—6 of FIG. 4.

Referring now to FIGS. 3, 4, 5 and 6, the movable carriage section 12, which is identical in most respects to the fixed carriage section 10, consists essentially of a lower portion 46 characterized by its relatively narrow width so as to fit between the opposed band saw blades 18 and an upper portion 50 which cannot fit between the bandsaw blades 18, as can be seen in FIGS. 5 and 6. Common practice is to have the bandsaw blades slightly less than 4 inches apart when at their closest positions so as to be capable of sawing a nominal 4-inch dimension with provision for a slight loss at the planers. The lower portion 46 is constructed from two opposed side plates 52 structurally sandwiched so as to provide a space 54 therebetween. Front and rear facing plates 56 structurally connect the side plates 52 and attach the lower portion 46 to the upper portion 50.

The dog 16 is pivotably mounted on a relatively narrow dogging assembly 58 which is mounted to the side-plates 52 and adapted to be pivotably retracted into the space 54 between the side plates as shown in phantom in FIG. 3. A controllable hydraulic dogging cylinder 60 mounted between the side plates is pivotably connected to the dogging assembly 58 for selectively extending and retracting the dog 16 as also shown in FIG. 3. A controllable hydraulic locking cylinder 62, also mounted between the side plates, is positioned to engage a tang of the dog assembly 58 and lock the dog in the extended position so that the dogging cylinder 60 does not have to oppose the force exerted by the log 40 on the dog 16 when the log is clamped between the respective carriage sections. As can be seen in FIGS. 3, 4 and 5, the dog does not have to be sufficiently narrow in width to fit within the space 54, the side plates 52 being cut away to accommodate the retracted dog, but the dog must be narrow enough to fit between the opposed band saw blades 18. It should also be noted that the dog has a textured gripping face 64 to insure secure dogging of the log.

Turning now to the upper portion 50 of the movable carriage section 12, as shown in FIGS. 3, 4, 5 and 6, a spooling drum 32 is rotably mounted between two lower elongated structural members and coupled with a chain 66 and sprocket arrangement to two controllable, reversible hydraulic clamping motors, the forward clamping motor 34*a* and the rear clamping motor 34*b*. The spooling drum 32 has two toothed, flanged rims 68, each rim engaged by a separate endless chain 66, which is trained over respective sprockets 70, coupled to the respective claiming motors 34*a* and 34*b*. The sprocket 70 of the forward clamping motor 34*a* is coplanar with one toothed rim 68 of the spooling drum 32 and the sprocket 70 of the rear clamping motor 34*b* is co-planar with the other toothed rim 68. The clamping motors 34*a* and 34*b* are used in unison to selectively rotate the spooling drum 32.

As shown in FIG. 3 and as partially described above, the drive cable 26 is passed forward and wrapped clockwise several times around the spooling drum 32 and then anchored to the spooling drum. The clamping cable 36 has one end anchored to the spooling drum 32 and is wrapped clockwise several times around the spooling drum and then passed through the space 54 between the side plates 52 and under a free-turning pulley 38 also mounted in the space near the lower downstream edge of the movable carriage section 12. While the number of wraps taken by the drive cable 26 around the drive drum 30 is not crucial, sufficient wraps must be taken with the drive cable 26 and the clamping cable 36 around the spooling drum 32 to allow for the full range of length adjustment desired of the log carriage. For example, if the system is originally cabled up with the respective dogs of the log carriages ten feet apart, and the desired length adjustment for the log carriage is eight to twenty-four feet, at least two feet of drive cable 26 and fourteen feet of clamping cable 36 must be spooled on the spooling drum. Alternatively, a single cable may be used for both the drive cable 26 and the clamping cable 36, requiring only sufficient wraps around the spooling drum 32 to insure that the cable does not slip on the spooling drum when rotated, since an identical amount of cable is paid out by the spooling drum as is collected.

Each log carriage section is supportably guided on a longitudinally extending overhead track 14, best seen in FIGS. 5 and 6, consisting essentially of an H-beam and wear plates 72. The H-beam is supported by its upper flanges so that the web is vertically oriented, with the wear plates 72 horizontally attached to the lower flanges, one to each of the upper surfaces of the lower flanges, and one on the under surface of the lower flanges directly beneath the web. Each carriage section has four upper flat wheels 74, (FIGS. 2–4) for rollingly supporting the carriage sections on the upper wear plates, the flat wheels 74 being rotatably mounted on horizontally oriented shafts transverse to the track 14 which are supported on two upper elongated structural members which are in turn connected to the face plates 56.

The lateral biasing force which holds the carriage sections against the guide rail 20, as described above, is provided by torsion means associated with each carriage sections and explained below with reference only to the movable carriage section 12 as shown in FIGS. 4, 5 and 6. Referring to FIGS. 1 and 4, a pair of elongated torque shafts 76 arranged end-to-end are each rotatably mounted on the upper portion 50 of the carriage section parallel to the track 14 by a pair of shaft bearings 78. Torque arms 80 (FIGS. 4 and 6) are fixed to the inner ends of each torque shaft 76 (with respect to the carriage section) for rotation therewith, each torque arm 80 having a threaded set screw 82 extending therethrough and bearing against the carriage section for applying an adjustable rotational force to the torque shaft. At the outer end of each torque shaft 76, an axle arm 84 is fixed to the torque shaft for rotation therewith as shown in FIGS. 5 and 6. Rotatably mounted on each axle arm for rotation about a horizontal axis transverse to the track 14 is a V-wheel 86. The V-wheel is in continuous engagement with a longitudinally extending V-rail 88 parallel to and spaced laterally from the track 14. The V-rail 88 is rigidly mounted independent of the carriage section on an I-beam braced by a gusset 94. A brace 90 is fixed to the axle arm 84 with an adjustable stop 92 to prevent overtorqueing of the torque shaft 76, the stop 92 being adjusted to have approximately ¼ inch of free play when the torque is set. Tightening the set screws 82 which bear against the carriage section causes a rotational force in the torque shafts 76 through the torque arms 80, which is translated as an upward force to the V-rail 88 through the axle arm 84 and V-wheel 86. Since the V-rail 88 is rigidly mounted, the set screw 82 acting against the carriage section at the length of the torque arm 80 creates a rotational force in the log carriage section about the torque shaft 76. The effect of this rotational force at the extreme lower portion 46 of the carriage section is a reactive lateral biasing force which tends to force the bearings 24 of the carriage section against the guide rail 20 which is also rigidly mounted independent of the log carriage section.

It will be appreciated that the guide rail 20 must be extremely straight and the carriage path precisely parallel to the guide rail in order to achieve a high degree of cutting accuracy. For this reason, the four needle roller bearings 24 associated with each carriage section to engage the guide rail 20 are provided with adjustable eccentrically cammed journals to insure that the carriage path is parallel to the guide rail.

As previously described, each carriage section is longitudinally preloaded with a moment or rotational force when the log carriage is unloaded as a consequence of the cable tension acting at the cable attachment points. This moment is manifested as an upward force at the inner edge of each carriage section (with respect to the entire log carriage). To restrain the inner upper flat wheels of each carriage section from vertical movement off the track 14, a lower flat wheel 96 is provided, mounted below the track 14 and bearing on the lower wear plate 72 mounted thereon as shown in FIGS. 2, 3, 4 and 6. This lower flat wheel 96 may not be necessary if the inner V-wheel 86 of each carriage section supplies sufficient downward force to the inner portion of the respective carriage sections to prevent the carriage section from lifting off the track.

Except for the cables and spooling drum 32 with associated drive mechanisms, the foregoing description of the movable carriage section 12 is also applicable to the fixed carriage section 10, the two carriage sections being mirror images of each other as shown in FIG. 1. The detail shown in FIGS. 3, 4, 5 and 6 regarding bearings 24, dogging mechanisms, support structure, biasing means, and the like are all identical.

Figure 9:
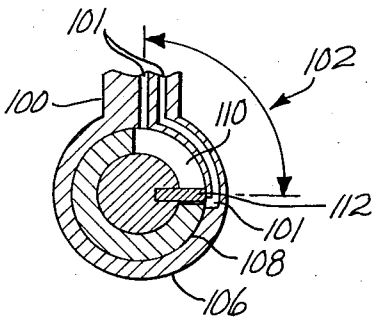
FIG. 9 is a cross-sectional view taken along line 9—9 of FIG. 8.
Figure 8:
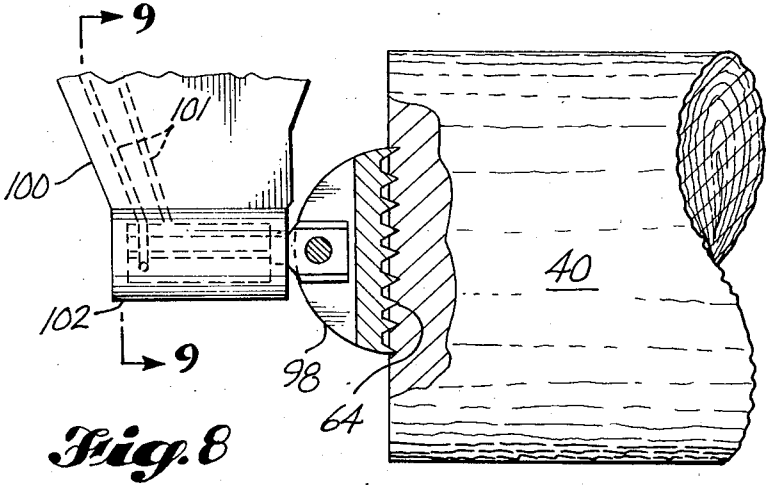
FIG. 8 is a side elevational, partially sectional view of a turning dog of the log carriage system.

An alternative embodiment of the present invention provides selectively extensible and retractable turning dogs 98 shown in FIG. 8 in place of the dogs 16 shown in FIG. 2. The turning dogs 98 are supported by turning dog assemblies 100 which are adapted to accommodate a rotary actuator, preferably a reversible hydraulic vane motor 102 small enough to fit between the band saw blades 18. Referring to FIGS. 8 and 9, the vane motor 102 is generally cylindrical in shape, having an axial shaft 104 rotatably mounted within an outer housing 106 by a partially enclosing elongated sleeve 108 defining a fluid chamber 110 between the shaft 104 and the housing 106. The sleeve 108 is fixed to the housing 106 while the axial shaft 104 is constrained to partial rotation within the sleeve and housing by an elongated vane 112 extending along and keyed to the shaft. Hydraulic fluid under pressure is selectively supplied to the chamber 110 through either of two ports (not shown) located on opposite sides of the vane 112 to selectively cause the vane 112 and shaft 104 to axially rotate 90° in either direction as shown in FIG. 9. While fluid is supplied through one port, it is exhausted through the other, the ports being connected to the hydraulic system of the carriage section through respective fluid passageways 101 and flexible hydraulic hoses (not shown), the latter permitting the motor 102 to extend and retract with the dog 98. The turning dog 98 is pivotably connected to an exterior portion of the shaft 104 for rotation therewith, and has a gripping face which is elongated and textured, preferably with spikes to ensure secure gripping of the log 40. The outside width dimension (i.e., diameter) of the vane motor 102 is substantially no greater than the maximum width dimension of the elongated gripping face to enable the motor 102 to follow the gripping face between a pair of closely spaced saw blades 18 when the gripping face has been rotated to a vertical orientation (as shown with respect to dog 16 in FIG. 5).

In operation, the log 40 is clamped between the respective turning dogs 98 of the carriage sections. The log may then be passed through the saws 18 as gripped or rotated 90° and then passed through the saws. In either case the log 40 may be again rotated and processed through the saws so that the final cant has four regular faces formed thereon. It will be apparent that if the log is to be processed with the saw blades 18 close together as shown in FIG. 5, the turning dog 98 must be rotated to enable its width to pass between the closely positioned saw blades during the final cuts.

Figure 7:
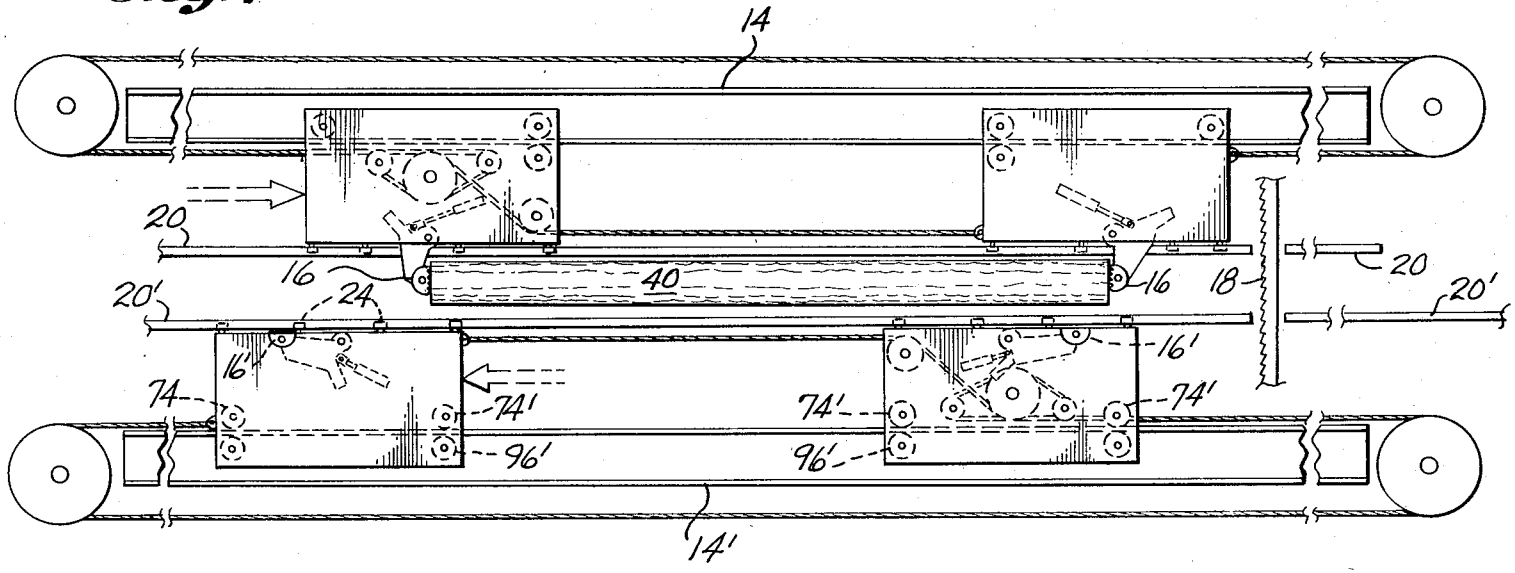
FIG. 7 is a side elevational view of a tandem embodiment of the log carriage system.

FIG. 7 illustrates the alternative use of a log carriage system of the present invention as an underneath-supported end-dogging log carriage, and also shows a pair of log carriages according to the present invention used in tandem as underneath and overhead end-dogging log carriages. In an underneath-supported configuration of the present invention, the V-wheel and V-rail previously discussed and/or the flatwheel 96' on each carriage section carry the weight of the log carriage as well as provide the laterial biasing force required for the guiding system as can be seen by inverted viewing of FIG. 5 and FIG. 6, the biasing assembly providing sufficient upward force to press the flat wheels 74' against the wear plates mounted on the I-beam track 14'. As in the overhead version, the flat wheel 96' may not be crucial for supporting or guiding the carriage section and is provided along with the brace 90 and adjustable stop 92 to prevent over-torquing of the torque shafts 76 and as a safety feature. The operation of the driving, clamping and dogging mechanisms as well as the guide rail 20' and needle bearings 24' arrangement would be unaffected by the positional shift of the log carriage system. Shields, such as are commonly used in the industry in underneath end-dogging carriages would be desirable to keep sawdust and other wood debris off the underneath track 14', V-rail and portions of the carriage sections which incorporate the biasing and guiding assemblies.

Combining the overhead and underneath embodiments of the end-dogging log carriage system in tandem as shown in FIG. 7 could dramatically increase the throughput of the primary breakdown portion of a sawmill by using two log carriages to alternately pass logs through one array of log-processing equipment such as saws and chippers. In such an arrangement, the track 14', guide rail 20', and V-rail of the underneath log carriage are vertically coplanar with the corresponding features of the overhead carriage resulting in respective carriage paths which are also vertically coplanar. Sufficient vertical distance between the tandem log carriages is allowed to permit the log carriages to pass each other as shown in FIG. 7, where the overhead log carriage with dogs 16 extended and a log 40 clamped therebetween is shown moving downstream towards the saws while the underneath log carriage with dogs 16' retracted is shown moving back upstream to obtain another log. In operation, the tandem log carriages would reciprocatingly travel along their respective tracks 14, 14' passing logs through the saws 18 in alternating fashion. Thus a rapid succession of logs may be processed without the customary delay required to return the carriage to the infeed area, adjust the log carriage length and dog a log.

Modifications are required in related equipment and structure which cooperate with the log carriage system for the tandem embodiment such as a variable position side charger which can load both overhead and underneath log carriages without interfering therewith, and provisions in the outfeed area to ensure the undogged cants are removed from the carriage path.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An end-dogging log carriage system for processing random-length logs, comprising:

an elongated track;

a pair of log carriage sections supportably guided on said track, each of said carriage sections including respective dogging means for supportably engaging one end of a log;

carriage drive means including an elongated flexible drive tension member extending between and interconnecting said respective carriage sections for selectively driving said carriage sections in unison along said track;

clamping means for selectively adjusting the length of said log carriage by moving one of said carriage sections along said track with respect to the other one of said carriage sections and clamping a log therebetween without detaching either of said carriage sections from said drive tension member, said clamping means including means for selectively changing the operative length of said drive tension member between said carriage sections in response to the movement of one of said carriage sections along said track with respect to the other one of said carriage sections;

wherein said clamping means includes an elongated flexible clamping tension member extending between and interconnecting said respective log carriage sections for moving one of said log carriage sections along said track with respect to the other one of said log carriage sections; and wherein said means for changing the length of said drive tension member comprises spooling means mounted on one of said carriage sections and connected to said drive tension member and said clamping tension member for simultaneously shortening the operative length of one of said tension members while lengthening the operative length of the other of said tension members.

2. An end-dogging log carriage system comprising:

respective first and second carriage sections each including respective dogging means for dogging a respective end of a log, said first carriage section being supportably and movably guided for relative movement selectively toward and away from said second carriage section;

log clamping means for applying a first force to said first carriage section tending to move said first carriage section toward said second carriage section for dogging a log therebetween, said first force imposing a dogging moment upon said first carriage section while said log is dogged;

counter-moment means for applying a second force to said first carriage section, in a direction opposite to said first force, for imposing on said first carriage section a moment in opposition to said dogging moment; and wherein said log clamping means applies said first force to said first carriage section at a first location and said counter-moment means applies said second force to said first carriage section at a second location, said first location being vertically intermediate said dogging means and said second location.

3. The log carriage system of claim 2 wherein said log clamping means includes means for imposing dogging moments upon both said first and second carriage sections, and said counter-moment means includes means for imposing upon both of the first and second carriage sections moments in opposition to said dogging moments.

4. An end-dogging log carriage system comprising:

an elongated track;

respective first and second carriage sections each including respective dogging means for dogging a respective end of a log, said first carriage section being supportably and movably guided for relative movement selectively toward and away from said second carriage section;

log clamping means for applying a first force to said first carriage section tending to move said first carriage section toward said second carriage section for dogging a log therebetween, said first force imposing a dogging moment upon said first carriage section while said log is dogged;

counter-moment means for applying a second force to said first carriage section, in a direction opposite to said first force, for imposing on said first carriage section a moment in opposition to said dogging moment;

wherein said first and second carriage sections are supportably guided on said elongated track, and said countermost means comprising carriage drive means including an elongated flexible drive tension member extending between and interconnecting said first and second carriage sections for selectively driving said first and second carriage sections in unison along said track; and wherein said clamping means comprises an elongated flexible clamping tension member extending between and connecting said first and second carriage sections.

5. The log carriage system of claim 4 wherein said clamping means further comprises spooling means mounted on one of said carriage sections and connected to said clamping tension member and said drive tension member for simultaneously shortening the operative length of one of said tension members while lengthening the operative length of the other of said tension members.

6. An end-dogging log carriage system having a log carriage with means for gripping the ends of a log therebetween supportably guided on an elongated track for movement through log processing equipment, said system comprising:

elongated carriage guide means extending parallel to said track and spaced vertically downwardly therefrom along one side of said log carriage, for guiding said log carriage through said log processing equipment; and biasing means for forcing said log carriage sideways against said carriage guide means as said carriage moves through said log processing equipment.

7. The log carriage system of claim 6 wherein said log carriage comprises a pair of rigid carriage sections, each including respective means for gripping a respective end of a log and each having respective biasing means for forcing the respective carriage section sideways against said carriage guide means.

8. An end-dogging log carriage system having a log carriage with means for gripping the ends of a log therebetween supportably guided on an elongated track for movement through log processing equipment, said system comprising:

elongated carriage guide means extending parallel to said track and spaced therefrom for engaging one side of said log carriage and guiding said log carriage through said log processing equipment; and biasing means for forcing said log carriage sideways against said carriage guide means in a direction transverse to said track as said carriage moves through said log processing equipment, said biasing means comprising torsion means for applying a rotational force to said log carriage in a direction transverse to said carriage track.

9. The log carriage system of claim 8 wherein said torsion means comprises:

a longitudinally extending elongated bearing surface extending parallel to said track and spaced laterally therefrom;

wheel means for rollingly engaging said bearing surface;

a longitudinally extending elongated torque shaft rotatably mounted on said carriage parallel to said track;

axle arm means radially fixed to said torque shaft for rotation therewith and rotatably mounting said wheel means for transmitting torque between said torque shaft and said bearing surface through said wheel means, and torque arm means radially fixed to said torque shaft for rotation therewith spaced longitudinally from said axle arm means and bearing against said carriage for applying said rotational force to said carriage.

10. An end-dogging log carriage system having a log carriage with means for gripping the ends of a log therebetween supportably guided on an elongated track for movement through log processing equipment, said system comprising:

elongated carriage guide means extending parallel to said track and spaced therefrom for engaging one side of said log carriage and guiding said log carriage through said log processing equipment; and biasing means for forcing said log carriage sideways against said carriage guide means in a direction transverse to said track as said carriage moves through said log processing equipment;

wherein said carriage guide means comprises a vertically oriented linear guide surface located vertically intermediate said track and said means for gripping the end of a log.

11. The log carriage system of claim 10 wherein said guide surface is discontinuous immediately proximate said log processing equipment so as to have two portions defining a gap therebetween occupied by said log processing equipment.

12. The log carriage system of claim 11 wherein said log carriage comprises a pair of carriage sections, each of said carriage sections having associated therewith said biasing means, each of said carriage sections having a length which is more than twice said gap so as to span said gap while simultaneously contacting both of said portions of said guide surface proximate said log processing equipment.

13. An end-dogging log carriage system having a log carriage supportably guided on an elongated overhead track and a carriage guide system for accurately guiding said log carriage movably through a pair of opposed saws for simultaneously sawing opposite sides of a log, said system comprising:

a pair of log carriage sections having respective opposed dogs for supportably engaging said log proximate the ends thereof and passing said log through said pair of opposed saws;

carriage guide means extending parallel to said overhead track and located vertically between said overhead track and said dogs for engaging said log carriage sections and guiding said sections longitudinally through said pair of opposed saws, said carriage guide means having a guide surface which is discontinuous proximate said pair of opposed saws so as to have two portions defining a gap therebetween occupied by at least one of said saws;

each of said log carriage sections having a length which is more than twice said gap so as to span said gap while simultaneously contacting both said portions of said guide surface proximate said pair of opposed saws.

14. An end-dogging log carriage system having a log carriage supportably guided on an elongated overhead track and a carriage guide system for accurately guiding said log carriage movably through a pair of opposed saws for simultaneously sawing opposite sides of a log, said system comprising:

a pair of log carriage sections having respective opposed dogs for supportably engaging said log proximate the ends thereof and passing said log through said pair of opposed saws;

carriage guide means extending parallel to said overhead track and located vertically between said overhead track and said dogs for engaging said log carriage sections and guiding said sections longitudinally through said pair of opposed saws, said carriage guide means having a guide surface which is discontinuous proximate said pair of opposed saws so as to have two portions defining a gap therebetween occupied by at least one of said saws;

said log carriage sections each including at least three longitudinally spaced bearing means for movably engaging said guide surface, said respective bearing means being spaced longitudinally so that at least two of said bearing means simultaneously contact said guide surface proximate said gap at all times while said log carriage is moving through said pair of opposed saws.

15. The log carriage system of claim 13 or 14 further comprising biasing means associated with each of said carriage sections for forcing said carriage sections sideways against said carriage guide means in a direction transverse to said carriage guide means.

16. The log carriage system of claim 15 or 14 wherein said carriage guide means comprises a vertically oriented linear guide surface vertically intermediate said track and said dogs.

17. An end-dogging log carriage system for reciprocatingly passing logs through log processing equipment comprising:

an elongated overhead track;

an elongated underneath track parallel to the vertically coplanar with said overhead track;

an overhead log carriages supportably guided on said overhead track for longitudinal movement along said overhead track;

an underneath log carriage supportably guided on said underneath track for longitudinal movement along said underneath track;

each of said underneath and overhead log carriages having respective opposed dogging means mounted thereon which are extensible and retractable, respectively, toward and away from the other one of said log carriages, each of said respective dogging means being adaptable for engagingly supporting a log proximate the ends thereof when extended;

said overhead log carriage and said underneath log carriage each having respective carriage drive means for selectively moving said respective overhead and underneath log carriage through said log processing equipment in an alternating reciprocating fashion wherein said respective log carriages pass each other while moving longitudinally in opposite directions, said respective dogging means being sufficiently retractable that said respective log carriages can pass each other without interference therebetween when the dogging means of one carriage is retracted and the dogging means of the other carriage is extended.

18. The log carriage system of claim 17, wherein each log carriage comprises a first carriage section supportively guided on its track, for movement along the track, and a second carriage section supportively guided on its track, for movement along the track, wherein each log carriage includes a cable drive system including a first cable sheave at one end of its track, a second cable sheave at its second end of its track, a cable drum carried by its second carriage section, cable means extending from a first point of connection to the first carriage section to and then over the first cable sheave, then extending to and over the second cable sheave, and then extending to the cable drum, and being wrapped about said cable drum, and then extending to a second point of connection to the first carriage section;

first reversible drive means connected to one of said cable sheaves, for rotating said sheave;

second reversible rotary drive means for rotating said cable drum relative to said second carriage section;

whereby operation of the first drive means to rotate the cable sheave to which it is connected will move the cable means about both sheaves, and the moving cable means will carry with it both carriage sections and any log clamped between the carriage sections, and rotation of the cable drum will cause the second carriage section to move in position along the cable means relative to the first carriage section, for adjusting the carriage to the length of a particular log to be handled.

19. A carriage system according to claim 18, further including means for guiding and stabilizing each carriage section, said means comprising an elongated guide rail spaced vertically from each said track, each said guide rail extending substantially parallel with its track, in a position to be contacted by side portions of the carriage sections as they are moved along the track, and means for providing a sideways moment on the carriage sections, urging each towards its guide rail.

20. A carriage system according to claim 19, wherein the means for exerting a sideways moment on the carriage section comprises a second elongated rail spaced laterally outwardly from each track, and arm means extending outwardly from each carriage section towards its second rail, said arm means carrying guide means which engage the second rail.

21. A carriage system according to claim 20, wherein each carriage section carries an elongated torsion bar, each torsion bar having a first end portion connected to said arm, and means at its opposite end for twisting the torsion bar, in a direction urging the arm and its guide means into contact with its second rail, and the carriage section into contact with its first rail.

22. A carriage system, comprising:

an elongated track;

a first carriage section supportively guided on said track, for movement longitudinally of the track;

a second carriage section supportively guided on said track, for movement longitudinally of the track;

a first cable sheave at one end of the track;

a second cable sheave at the second end of the track;

a cable drum carried by the second carriage section;

cable means extending from a first point of connection to the first carriage section to and then over the first cable sheave, then extending to and over the second cable sheave, and then extending to the cable drum, and being wrapped about said cable drum, and then extending to a second point of connection to the first carriage section;

first reversible drive means connected to one of said cable sheaves, for rotating said sheave;

second reversible rotary drive means for rotating said cable drum relative to said second carriage section;

first connector means carried by the first carriage section, for connecting to one end of an object positioned between the two carriage sections; and second connector means carried by the second carriage section, for connecting to the second end of an object positioned between the two carriage sections, whereby operation of the first drive means to rotate the cable sheave to which it is connected will move the cable means about both sheaves and the moving cable means will carry with it both carriage sections and any object connected to the carriage sections, and rotation of the cable drum will cause the second carriage section to move in position along the cable means relative to the first carriage section.

23. A carriage system according to claim 22, further including means for guiding and stabilizing the carriage sections, said means comprising an elongated guide rail spaced vertically from said track, and extending substantially parallel to said track, in a position to be contacted by side portions of the carriage sections as they are moved along the track, and means for providing a sideways moment on the carriage sections, urging them towards said guide rail.

24. A carriage system according to claim 23, wherein the means for exerting a sideways moment on the carriage section comprises a second elongated rail spaced laterally outwardly from the track, and arm means extending outwardly from each carriage section towards the second rail, said arm means carrying guide means which engage the second rail.

25. A carriage system according to claim 24, wherein each carriage section carries an elongated torsion bar, each torsion bar having a first end portion connected to said arm, and means at its opposite end for twisting the torsion bar, in a direction urging the arm and its guide means into contact with the second rail, and the carriage section into contact with the first rail.

26. A method of engaging and carrying a random length object through a processing station, comprising:

establishing an elongated track to extend to and through the processing station;

supportively guiding a first carriage section on said track, for movement along the track;

supportively guiding a second carriage section on said track, for movement along the track;

locating a first cable sheave at one end of the track;

locating a second cable sheave at the second end of the track;

locating a reversible rotary cable drum on the second carriage;

connecting a cable means to a first point of connection to the first carriage section, then extending the cable means to and over the first cable sheave, then to and over the second cable sheave, and then to and over and around said cable drum, so that it is wrapped onto said cable drum, and then to a second point of connection to the first carriage section;

providing a reversible rotary drive means and connecting it to one of said cable sheaves, for rotating said sheave;

providing a second reversible rotary drive means for rotating said cable drum relative to said second carriage section;

providing a first connector means on the first carriage section, for use in connecting one end of an object positioned between two carriage sections, to said first carriage section;

providing a second connector means on the second carriage section, for connecting the second end of an object positioned between the two carriage sections to said second carriage section;

operating the first reversible rotary drive means for rotating the cable sheave to which it is connected, for moving the cable means about both sheaves, and moving the two carriage sections and any object connected to them in position relatively along the elongated track; and adjusting the distance between the two carriage sections, to fit the length of a particular object to be carried, by operating the second reversible rotary drive means for rotating the cable drum, to cause the second carriage section to move in position along the cable means relative to the first carriage section.

27. A method according to claim 26, comprising guiding and stabilizing the carriage sections by providing an elongated guide rail in a position to be contacted by side portions of the carriage sections as they are moved along the track, and providing a sideways moment on the carriage sections, urging them towards said guide rail.

28. A method according to claim 34, comprising exerting a sideways moment on the carriage sections by locating a second elongated rail laterally outwardly from the track, and providing arm means on the carriage sections which extend outwardly towards the second rail, and providing guide means on the arm means which engage the second rail.

29. A carriage system, comprising:

an elongated track;

a first carriage section supportively guided on said track, for movement longitudinally of the track;

a second carriage section supportively guided on said track, for movement longitudinally of the track;

first connector means carried by the first carriage section, for connecting to an object positioned between the two carriage sections;

second connector means carried by the second carriage section, for also connecting to an object positioned between the two carriage sections, means for moving the carriage sections relatively together and apart, for adjusting the space between the carriage sections to a particular object to be carried by the carriage sections;

means for moving the carriage sections and any object between them relatively along the track;

means for guiding and stabilizing the carriage sections, said means comprising an elongated guide rail spaced vertically below said track, and extending substantially parallel to said track, in a position to be contacted by side portions of the carriage sections as they are moved along the track, and means for providing a sideways moment on the carriage sections, urging them towards said guide rail.

30. A carriage system according to claim 29, wherein the means for exerting a sideways moment on the carriage sections comprises a second elongated rail spaced laterally outwardly from the track, and arm means extending outwardly from each carriage section towards the second rail, said arm means carrying guide means which engage the second rail.

31. A carriage system according to claim 30, wherein each carriage section comprises an elongated torsion bar, each torsion bar having a first end portion connected to the said arm, and means at its opposite end for twisting the torsion bar, in a direction urging the arm and its guide means into contact with the second rail, and the carriage section into contact with the first rail.

32. A carriage system, comprising:

an elongated track;

a first carriage section supportively guided on said track, for movement longitudinally of the track;

a second carriage section supportively guided on said track, for movement longitudinally of the track;

a cable drum carried by at least the second carriage section;

cable means spaced vertically from said track, said cable means extending to the cable drum, and being wrapped about said cable drum, and then extending to the first carriage section;

reversible rotary drive means for rotating said cable drum relative to said second carriage section;

first connector means carried by the first carriage section, for connecting to one end of an object positioned between the two carriage sections; and second connector means carried by the second carriage section, for connecting to the second end of an object positioned between the two carriage sections, whereby rotation of the cable drum will cause the second carriage section to move in position along the cable means relative to the first carriage section.

33. A carriage system, according to claim 32, further comprising a first cable sheave at one end of the track, a second cable sheave at the other end of the track, and reversible drive means connected to one of said sheaves, wherein said cable means extends from the first carriage section to and over the first sheave, then to the second sheave, then to the cable drum on the second carriage section, then back to the first carriage section, said first carriage section including means for connecting it to the cable means, and wherein operation of the reversible drive means connected to said sheave to rotate said sheave will move the cable means about both sheaves and the moving cable means will carry with it both carriage sections and any object held between them.

34. An end-dogging log carriage system comprising a log carriage section, dogging means for gripping an end of a log, said dogging means comprising a support arm having a free end, a rotary hydraulic actuator means housed within said free end, said actuator means including a rotor, and a dog element secured to said rotor, means for delivering hydraulic fluid to and from said actuator means, for rotating the rotor and the dog element connected thereto, said actuator means permitting selective rotation of the dog element at least through a ninety degree angle;

wherein said rotor comprises a shaft, a vane connected to said shaft and extending radially from the shaft, and housing means defining with said vane and shaft a ninety degree chamber, and said means for supplying hydraulic fluid comprises a first passageway entering into the chamber at one angular end thereof and a second passageway entering into the chamber at the opposite angular end thereof, whereby hydraulic fluid supplied through a first one of the passageways, while the second passageway is at return pressure, will move the vane and the dog element ninety degrees in position, and introduction of pressure into the second passageway while the first passageway is connected to return pressure will cause the vane and the dog element to rotate back ninety degrees.

35. The log carriage system of claim 34, wherein the dog element comprises a log-gripping face having a predetermined maximum width dimension and said rotary actuator has a predetermined maximum width dimension substantially no greater than said maximum width dimension of said log-gripping face.

36. A log carriage system for processing random-length logs, comprising:

an elongated track;

a pair of log carriage sections supportably guided on said track, each of said carriage sections including means for supportably engaging one end of a log;

carriage drive means including an elongated flexible drive tension member which is connected to both log carriage sections;

drive means for moving the elongated flexible drive tension member along its axis, with said log carriage sections moving with said elongated flexible drive tension member as it moves; and means for adjusting the distance that the two log carriage sections are spaced apart along said track, for the purpose of adjusting the distance between the respective means for supportably engaging one end of a log, to in that manner adjust the system to a log of a particular length, said means comprising an elongated flexible clamping tension member extending between and interconnecting said respective log carriage sections, and spooling means mounted on a first one of said carriage sections, said spooling means engaging said elongated flexible clamping tension member; and drive means for said spooling means operable to rotate the spooling means in one direction, for lengthening the elongated flexible clamping tension member, and in the opposite direction for shortening said elongated flexible clamping tension member.

37. The log carriage system of claim 36, wherein said elongated flexible clamping tension member is secured to a second one of said carriage sections.

* * * * *

UNITED STATES PATENT AND TRADEMARK OFFICE

CERTIFICATE OF CORRECTION

PATENT NO. : 4,697,487

DATED : October 6, 1987

INVENTOR(S) : Robert E. Cameron

It is certified that error appears in the above-identified patent and that said Letters Patent are hereby corrected as shown below:

Column 1, line 39, "betweem" should be -- between --.

Column 3, line 61, "and" should be -- an --.

Claim 4, column 15, line 48, "countermost" should be -- countermoment --.

Claim 16, column 18, line 4, "15 or 14" should be -- 13 or 14 --.

Claim 17, column 18, line 14, "carriages" should be -- carriage --.

Claim 28, column 21, line 4, "claim 34" should be -- claim 27 --.

Signed and Sealed this

Twelfth Day of April, 1988

*Attest:*

DONALD J. QUIGG

*Attesting Officer*

*Commissioner of Patents and Trademarks*